United States Patent [19]

Akamatsu

[11] 4,064,777

[45] Dec. 27, 1977

[54] CIRCUIT FOR PREFERENTIALLY SELECTING HIGHEST AND LOWEST TONES

[75] Inventor: Keiji Akamatsu, Osaka, Japan

[73] Assignee: Roland Corporation, Japan

[21] Appl. No.: 718,195

[22] Filed: Aug. 26, 1976

[30] Foreign Application Priority Data

Sept. 8, 1975 Japan ..... 50-109318

[51] Int. Cl.[2] ..... G10H 1/00; G10H 5/06

[52] U.S. Cl. ..... 84/1.03; 84/DIG. 2; 84/DIG. 12; 84/DIG. 20; 84/DIG. 22

[58] Field of Search ..... 84/1.01, 1.03, 1.13, 84/1.17, 1.24, 1.26, DIG. 2, DIG. 12, DIG. 20, DIG. 22

[56] References Cited

U.S. PATENT DOCUMENTS

| | | | |
|---|---|---|---|
| 3,766,305 | 10/1973 | Schrecongost | 84/1.01 |
| 3,880,039 | 4/1975 | Studer | 84/1.01 |
| 3,906,830 | 9/1975 | Mathias | 84/1.01 |

*Primary Examiner*—Stanley J. Witkowski

*Attorney, Agent, or Firm*—Wenderoth, Lind & Ponack

[57] ABSTRACT

A circuit in an electronic keyboard musical instrument for preferentially selecting the highest and lowest tones from among the tones in chords produced by keys on the keyboard which have been struck. The circuit has a set of series connected resistors having equal values, the number of resistors in the set corresponding to the number of tones from which the highest and lowest tones are to be selected. An end resistor is connected between each end of the set of resistors and a reference voltage level. A plurality of transistors corresponding to the number of resistors each has the emitter thereof connected to the set of resistors between the corresponding resistor and the resistor corresponding to the next adjacent transistor, and has the collector thereof adapted to receive a corresponding tone signal. A keyswitch is connected to the base of each transistor and to a bias source. Switches are connected to each end of the series of resistors for being alternately opened and closed in synchronism, and a shaping and amplifying circuit is coupled to these switches for alternately receiving signals from opposite ends of the set of resistors.

4 Claims, 13 Drawing Figures

+B
G1
G2
G3
G4
G5
Gn
Gn-1
S1
S2
S3
S4
S5
Sn
Sn-1
Q1
Q2
Q3
Q4
Q5
Qn
Qn-1
R1
R2
R3
R4
R5
R6
Rn
Rn-1
Rn+1
Rl
Rh
OL
OH
ERl
ERh
Sa
Sb
Comparator
CA
Flip-flop
F
Frequency Divider
D
BS
Gate Circuit
Gt
RH
Rhythm Generator
P
Tempo Oscillator

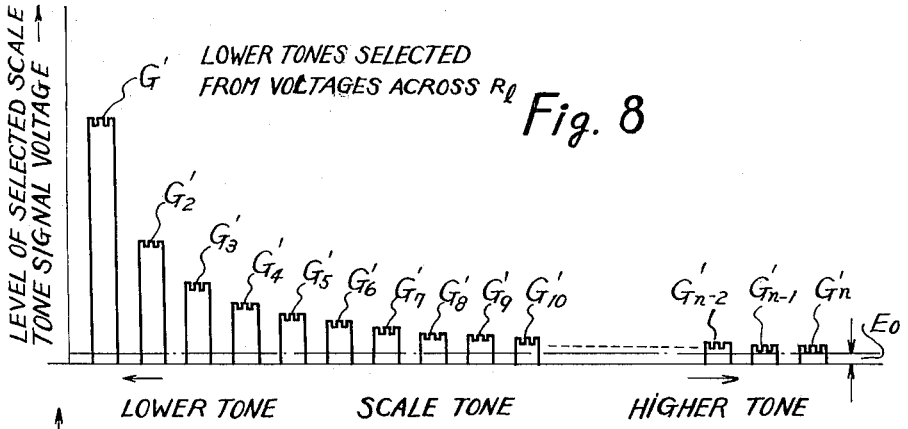
LEVEL OF SELECTED SCALE TONE SIGNAL VOLTAGE
LOWER TONES SELECTED FROM VOLTAGES ACROSS $R_l$
Fig. 8
$G'$ $G'_2$ $G'_3$ $G'_4$ $G'_5$ $G'_6$ $G'_7$ $G'_8$ $G'_9$ $G'_{10}$ $G'_{n-2}$ $G'_{n-1}$ $G'_n$
$E_0$
LOWER TONE
SCALE TONE
HIGHER TONE

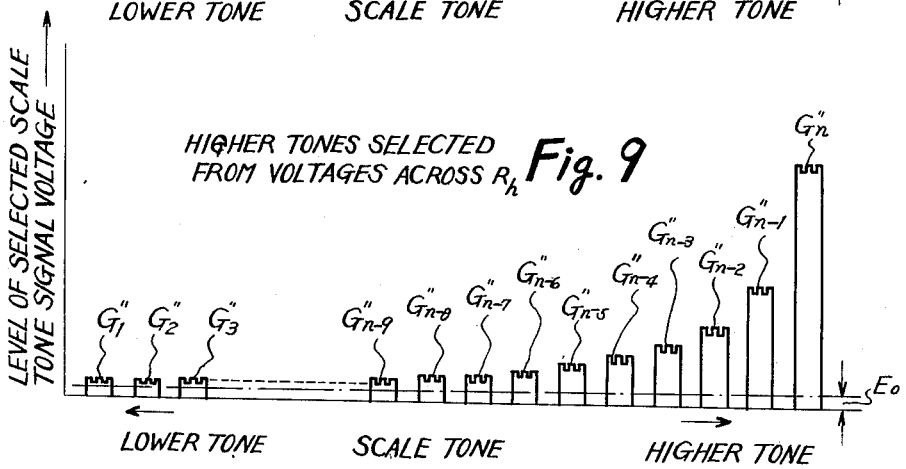
LEVEL OF SELECTED SCALE TONE SIGNAL VOLTAGE
HIGHER TONES SELECTED FROM VOLTAGES ACROSS $R_h$
Fig. 9
$G''_1$ $G''_2$ $G''_3$ $G''_{n-9}$ $G''_{n-8}$ $G''_{n-7}$ $G''_{n-6}$ $G''_{n-5}$ $G''_{n-4}$ $G''_{n-3}$ $G''_{n-2}$ $G''_{n-1}$ $G''_n$
$E_0$
LOWER TONE
SCALE TONE
HIGHER TONE

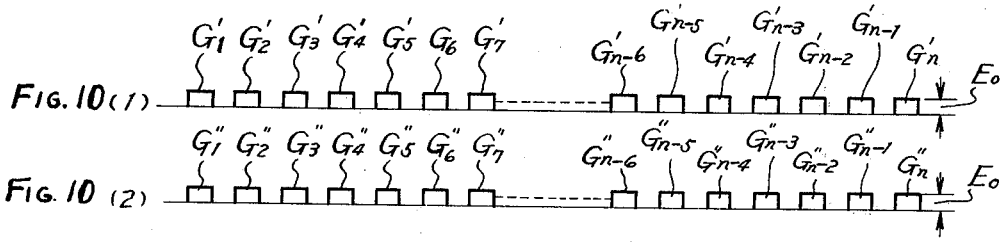
FIG. 10 (1)
$G'_1$ $G'_2$ $G'_3$ $G'_4$ $G'_5$ $G'_6$ $G'_7$ $G'_{n-6}$ $G'_{n-5}$ $G'_{n-4}$ $G'_{n-3}$ $G'_{n-2}$ $G'_{n-1}$ $G'_n$
$E_0$
FIG. 10 (2)
$G''_1$ $G''_2$ $G''_3$ $G''_4$ $G''_5$ $G''_6$ $G''_7$ $G''_{n-6}$ $G''_{n-5}$ $G''_{n-4}$ $G''_{n-3}$ $G''_{n-2}$ $G''_{n-1}$ $G''_n$
$E_0$

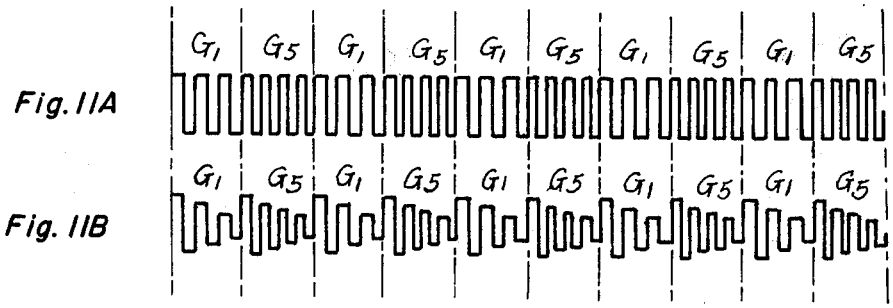
Fig. 11A
$G_1$ $G_5$ $G_1$ $G_5$ $G_1$ $G_5$ $G_1$ $G_5$ $G_1$ $G_5$
Fig. 11B
$G_1$ $G_5$ $G_1$ $G_5$ $G_1$ $G_5$ $G_1$ $G_5$ $G_1$ $G_5$

CIRCUIT FOR PREFERENTIALLY SELECTING HIGHEST AND LOWEST TONES

This invention relates to an electronic keyboard musical instrument having a circuit for preferentially selecting the highest and lowest tone from among the tones in the chords produced by the keys on the keyboard which have been struck by the left hand of the person playing the instrument.

BACKGROUND OF THE INVENTION AND PRIOR ART

A natural accompaniment effect has been generally obtained in an electronic musical instrument by automatically selecting the highest and lowest tones from among the chords produced by the keys which have been struck by the left hand of the player to thereby alternately sound in accordance with the rhythm, but the means for achieving the above effect has necessitated a plurality of rows of key switches coupled with the respective keys. Such an arrangement increases the rate of possible faults in the switches and increases the cost of manufacture.

OBJECT AND BRIEF SUMMARY OF THE INVENTION

It is the object of the present invention to provide a circuit for achieving the desired automatic accompaniment effect which is simpler and more trouble-free than the circuits of the prior art.

This object is achieved according to the present invention by providing merely a train of switches, so that the circuit is much simpler than that of the prior art and failures of the contacts will be greatly decreased.

The circuit according to the invention comprises a set of series connected resistors having equal values, the number of resistors in said set corresponding to the number of tones from which the highest and lowest tones are to be selected, an end resistor connected between each end of the set of resistors and a reference voltage level, a plurality of transistors corresponding to the number of resistors and each having the emitter thereof connected to the set of resistors between the corresponding resistor and the resistor corresponding to the next adjacent transistor, and having the collectors thereof adapted to receive a corresponding tone signal, a plurality of keyswitches, one connected to the base of each transistor and to a bias source, two switch means, one connected to each end of said series of resistors, means connected to said switch means for alternately opening and closing said switch means in synchronism, and a shaping and amplifying means coupled to said switch means for alternately receiving signals from opposite ends of said set of resistors through said switch means.

BRIEF DESCRIPTION OF THE DRAWINGS

FIGS. 8 and 9 are graphs showing respective levels of selected scale tone signal voltages selected from among output scale tone signal voltages appearing across the resistors $R_l$ and $R_h$, respectively;

FIG. 10(1) is a graph of a group of lower tone preference scale tone signal voltages;

FIG. 10(2) is a graph of a group of higher tone preference scale tone signal voltages; and FIGS. 11A and 11B are graphs of scale tone signal wave forms of lower and higher tones.

DETAILED DESCRIPTION OF THE INVENTION

Figure 1:
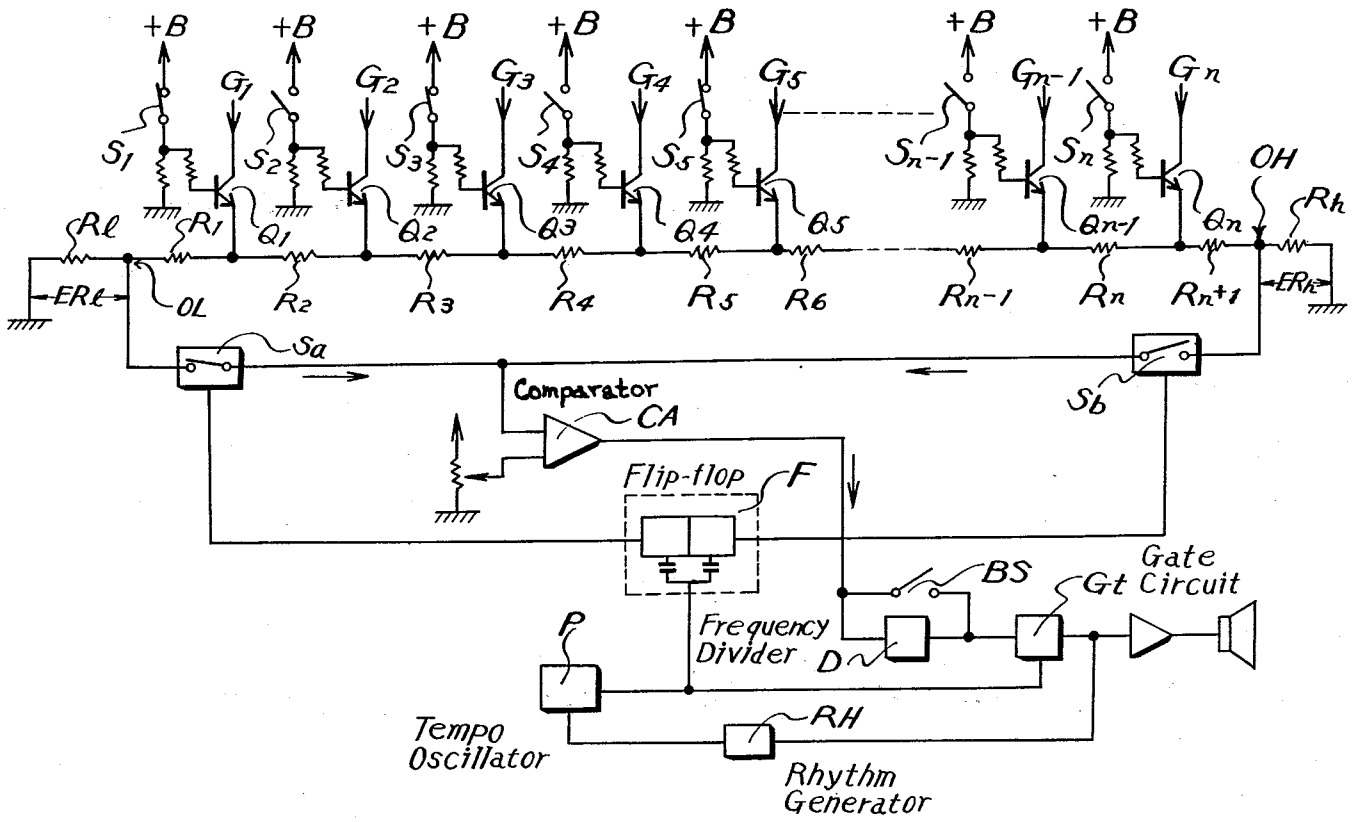
FIG. 1 is a schematic circuit diagram of an embodiment of the circuit according to this invention.

The embodiment of the circuit of this invention as shown in FIG. 1 comprises a set of series connected resistors $R_l$, $R_1$, $R_2$...$R_n$; $R_{n+1}$, $R_h$; each having substantially the same resistance value or the resistance values of resistors $R_l$ and $R_h$ can be set lower than those of resistors $R_1$, $R_2$...$R_n$, $R_{n+1}$, the junction OL between the resistors $R_l$ and $R_1$ and the junction OH between the resistors $R_{n+1}$ and $R_h$ being connected by respective electronic switches $S_a$ and $S_b$ connected in series therebetween and which are adapted to be alternately switched on and off in synchronism with a tempo-oscillator P. A plurality of transistors $Q_1$, $Q_2$...$Q_{n-1}$ and $Q_n$ are provided and the respective emitters are connected to the series connected resistors between the resistors $R_1$ and $R_2$, $R_2$ and $R_3$...$R_n$ and $R_{n+1}$, respectively. Scale tone signals $G_1$, $G_2$ ... $G_n-1$ and $G_n$ corresponding to scale tones in the order of scale tones from the lowest tone $G_1$ to the highest tone $G_n$ are supplied to the collectors of the transistors. The bases of the respective transistors are connected to respective key switches $S_1$, $S_2$...$S_n$, which in turn are connected to a voltage source +B. Now, if an optional combination of several key switches, for example keyswitches $S_1$, $S_3$ and $S_5$ from among the key switches $S_1$, $S_2$...$S_n$ are closed by striking corresponding keys on the keyboard of the instrument, then respective bases of the transistors $Q_1$, $Q_3$ and $Q_5$ will be given a positive potential to cause respective base currents to flow, so that the transistors $Q_1$, $Q_3$ and $Q_5$ will become conductive, and, accordingly, the scale tone signals $G_1$, $G_3$ and $G_5$ will be supplied from the respective emitters of the transistors $Q_1$, $Q_3$ and $Q_5$ to the train of resistors $R_l$, $R_1$, ...$R_{n+1}$ and $R_h$, thereby to produce output scale tone signals at both end resistors $R_l$ and $R_h$, the output scale tone signal emerging at the resistor $R_l$ being substantially similar to the scale tone signal $G_1$ and that emerging at the resistor $R_h$ being substantially similar to the scale tone signal $G_5$ for a reason which will be more precisely described in the following.

Figure 2:
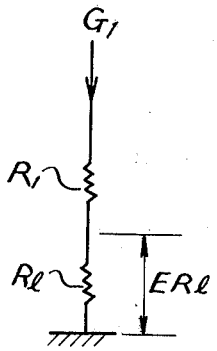
FIGS. 2–7 are diagrams of equivalent impedances for explaining the magnitude of the output scale tone signal voltage.

The scale tone signal flowing through the train of resistors will be seen to be divided into two components, the one being directed toward the resistor $R_l$ and the other being directed toward the resistor $R_h$. The current component of the former will now be considered. As can be represented by the circuit in FIG. 2, the scale tone signal $G_1$ will flow through the series connected resistors $R_1$ and $R_l$ and an output scale tone signal voltage $ER_l$ will be produced across the resistor $R_l$. The above signal voltage can be expressed by:

$$ER_l = VG_1 \times \frac{R_l}{R_1 + R_l} \tag{1}$$

where $VG_1$ denotes the voltage of the scale tone signal $G_1$.

Figure 3:
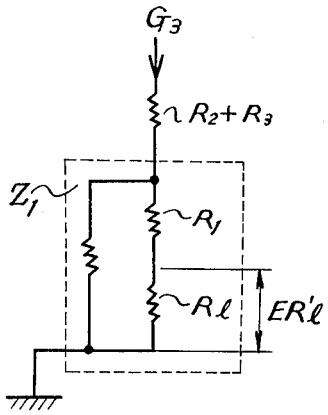

The scale tone signal $G_3$ will flow through the series impedance consisting of the resistors $R_2 + R_3$ and an impedance $Z_1$, as can be represented by the circuit in FIG. 3, so that an output scale tone signal $ER'_l$ will emerge across the resistor $R_1$, which signal can be expressed by:

$$ER'_l = VG_3 \times \frac{Z_1}{R_2 + R_3 + Z_1} \times \frac{R_l}{R_1 + R_l} \quad (2)$$

where $VG_3$ denotes the voltage of the scale tone signal $G_3$.

Figure 4:
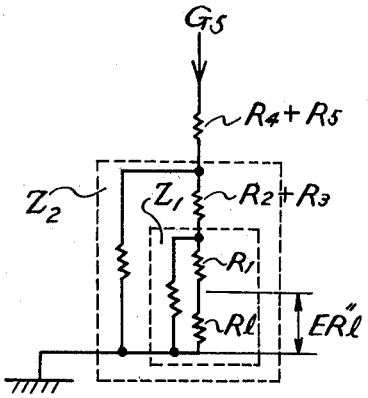

Further, the scale tone signal $G_5$ will flow through the series impedance consisting of the resistors $R_4 + R_5$ and an impedance $Z_2$, as can be represented by the circuit in FIG. 4 so that an output scale tone signal $ER''_l$ will emerge across the resistor $R_l$, which signal may be expressed:

$$ER''_l = VG_5 \times \frac{Z_2}{R_4 + R_5 + Z_2} \times \frac{Z_1}{R_2 + R_3 + Z_1} \times \frac{R_l}{R_1 + R_l} \quad (3)$$

where $VG_5$ denotes the voltage of the scale tone signal $G_5$.

The impedances $Z_1$ and $Z_2$ will now be described.

$Z_1$ is an impedance resulting from the transistor $Q_1$ and resistor $R_1$ as seen from the resistor $R_2$ when the transistor $Q_1$ is operating as an emitter follower, $Z_1$ being seen to be very low. Similarly, $Z_2$ is an impedance resulting from the transistor $Q_3$ and resistor $R_3$ as seen from the resistor $R_4$, and $Z_2$ being seen also to be very low. Accordingly, the output scale tone signal voltages $ER'_l$ and $ER''_l$, which are expressed by the formulae (2) and (3) are very low, and they are extremely low as compared with the output scale tone signal voltage $ER_l$ as expressed by the formula (1). Accordingly, the output scale tone signal voltage, which will emerge at the resistor $R_l$, will be seen to be produced substantially due to the scale tone signal $G_1$.

Figure 5:
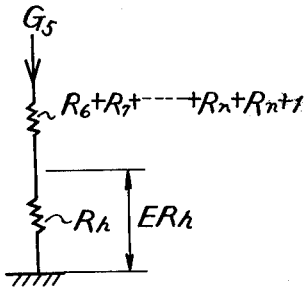

In the meantime, the scale tone signals are also flowing towards $R_h$ through the train of resistors. Similarly as described above, the output scale tone signal voltage $ER_h$, which will appear across the resistor $R_h$ due to the scale tone signal voltage $VG_5$, will be as produced by the equivalent circuit of FIG. 5, and expressed by the following formula:

$$ER_h = VG_5 \times \frac{R_h}{R_6 + R_7 + \ldots R_n + R_{n+1} + R_h}. \quad (4)$$

Figure 6:
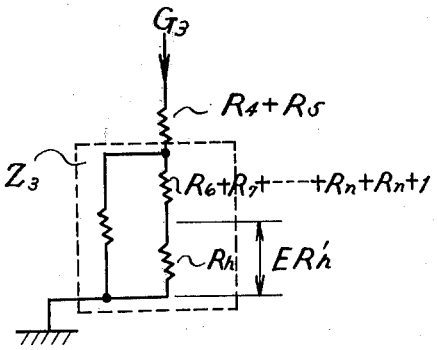

The output scale tone signal voltage $ER'_h$ which will appear across the resistor $R_h$ due to the scale tone signal voltage $VG_3$ will be as produced by the equivalent circuit of FIG. 6 and expressed by the formula:

$$ER'_h = VG_3 \times \frac{Z_3}{R_4 + R_5 + Z_3} \times \frac{R_h}{R_6 + R_7 + \ldots + R_n + R_{n+1} + R_h}. \quad (5)$$

Figure 7:
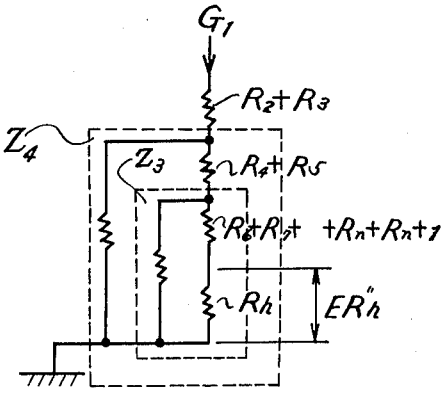

Further, the output scale tone signal voltage $ER''_h$ which will appear across the resistor $R_h$ due to the scale tone signal voltage $VG_1$, will be produced by the equivalent circuit of FIG. 7 and expressed by the formula:

$$ER''_h = VG_1 \times \frac{Z_4}{R_2 + R_3 + Z_4} \times \frac{Z_3}{R_4 + R_5 + Z_3} \times \quad (6)$$

-continued $$\frac{R_h}{R_6 + R_7 + \ldots + R_n + R_{n+1} + R_h}$$

Thus, the output scale tone signal voltage which will appear at the resistor $R_h$ must be the sum of the signal voltages according to the formulae (4), (5) and (6). But impedances $Z_3$ and $Z_4$ are very low, for reasons similar to those relating to the impedances $Z_1$ and $Z_2$, so that the output scale tone signal voltages $ER'_h$ and $ER''_h$ will also be very low, and they are extremely low as compared to the output scale tone signal voltage $ER_h$, which is expressed by the formula (4). Accordingly, the output scale tone signal voltage which will appear at the resistor $R_h$ will be substantially that due solely to the scale tone signal $G_5$.

From the above description it will be seen that, when the key switches $S_1$, $S_3$ and $S_5$ are closed simultaneously, output scale tone signal voltages will be produced at the resistors $R_l$ and $R_h$, said signal voltage at $R_l$ being substantially due to the scale tone signal $G_1$ and at $R_h$ being substantially due to the scale tone signal $G_5$. In practice the intermediate scale tone signals other than the highest and lowest scale tones which will be supplied when the several key switches have been closed will be suppressed by the lower impedances $Z_1$, $Z_2$, $Z_3$, $Z_4$, etc. sufficiently to be substantially eliminated, with the result that the highest and lowest scale tone signal voltages exist substantially above at the resistors $R_h$ and $R_l$.

In order to make any transistor as above to operate in an emitter-follower style or with collector grounded, resistors $R_l$ and $R_h$ as well as resistors $R_1$, $R_2 \ldots R_n$, $R_{n+1}$ being emitter resistors of transistors $Q_1$, $Q_2 \ldots Q_{n-1}$, $Q_n$, respectively, any resistor above mentioned should be suitably low in resistance value. In other words, above resistors $R_l$ and $R_h$, across which the output tone signal voltages are appearing, are seen to be low impedances, and both points OL and OH being low impedance output terminals.

The output scale tone signal voltages thus appearing across the resistors $R_l$ and $R_h$ will be alternately selected by the electronic switches $S_a$ and $S_b$ and introduced to a comparator $C_A$ connected between the two switches, said electronic switches $S_a$ and $S_b$ being adapted to repeat alternate switching on and off by the control signals provided by a flip-flop circuit F connected to the switches $S_a$ and $S_b$ to drive them, and which is driven by said tempo-oscillator P. The signal voltages selected from various output scale tone signal voltages appearing across the load resistor $R_l$ will have a higher voltage level the lower they are among the scale tones, as can be seen in FIG. 8, wherein $G_1$ through $G_n$ are selected scale tone signals obtainable across resistor $R_l$ corresponding to scale tone signals $G_1$ through $G_n$, respectively, and the signal voltages selected from various output scale tone signal voltages and appearing across the load resistor $R_h$ will have a higher voltage level the higher they are among the tones, as can be seen in FIG. 9, wherein $G_1''$ through $G_n''$ are selected scale tone signals obtainable across resistor $R_h$ corresponding to scale tone signals $G_1$ through $G_n$, respectively. On these selected scale tone signal voltages is necessarily superposed very small tone signals other than the lowest or highest scale tone signal, so that the desired tone signal must be shaped and amplified, in this embodiment by clipping at a voltage level $E_o$ by means of the comparator CA, to produce the selected lowest or highest scale tone voltage alone, and further it will be desirable to make them uniform at a level of selected scale tone signal voltage as shown in FIGS. 10 (1) and (2).

FIG. 10(1) shows a group of selected scale tone signal voltages which have been shaped to have a uniform level by the comparator CA after having been selected by the electronic switch $S_a$ (which voltages are hereinafter referred to as lower tone preference scale tone signal voltages), and FIG. 10(2) shows a group of selected scale tone signal voltages which have been shaped and amplified to have a uniform level by the comparator CA after having been selected by the electronic switch $S_b$ (which voltages are hereinafter referred to as higher tone preference scale tone signal voltages).

As described above, whenever several optionally selected key switches are closed by the actuation of corresponding keys, no matter how they have been combined, the lowest and highest scale tones alone will always be selected out of the scale tone signals corresponding to the closed key switches, and they will sound alternately, so that, if the chord keys are pushed down, an automatic accompaniment effect will be obtained. Further, the period of repetition of the higher and lower tones or the tempo of accompaniment will be determined by the frequency of the tempo-oscillator P, which is furnishing the pulse voltage to the flip-flop circuit F. As this tempo-oscillator separately controls a rhythm generator RH connected thereto, an automatic accompaniment effect in synchronism with the rhythmic sound will be achieved.

Furthermore, with respect to the wave forms of said lower tone preference scale tone signal voltages and said higher tone preference scale tone signal voltages, for example, the wave forms of the scale tone signals $G_1$ and $G_5$, which are continuous wave signals as shown in FIG. 11(A), these lower and higher scale tone preference scale tone signals are passed through a gate circuit $G_t$ coupled to the output of said comparator, which gate circuit can have any envelope character, and which circuit $G_t$ is controlled by the tempo-oscillator P which is connected thereto, whereby said scale tone signals $G_1$ and $G_5$ can be shaped into a damped envelope, as shown in FIG. 11 (B), for example. Further, if it is desired that the lower and higher tone preference scale tone signals be contained within base sounds, a parallel connected frequency divider D and base switch BS can be inserted between the comparator CA and the gate circuit $G_t$, as shown in FIG. 1, whereby a base sound will appear when the base switch BS is opened.

Because the lower and higher scale tone preference selecting circuit according to this invention can develop a natural automatic accompaniment effect by means of merely one train of key switches, there has been provided such an instrument in which there is much less likelihood of problems with the key switches, and which is less expensive than conventional instruments with such a function.

What is claimed is:

1. In an electronic keyboard musical instrument, a circuit for preferentially selecting the highest and the lowest tones from among the tones in chords produced by keys on the keyboard which have been struck, said circuit comprising:

a set of resistors having equal value connected in series, the number of resistors in said set being one more than the number of tones from which the highest and lowest tones are to be selected;

an end resistor connected between each end of said set of resistors and a reference voltage level;

a plurality of transistors each having the emitter thereof connected to said set of resistors at a junction between two resistors of said set which corresponds to the transistor and having the collector thereof adapted to receive a corresponding tone signal, the number of transistors corresponding to the number of tones from which the highest and lowest tones are to be selected;

a plurality of keyswitches, one connected to the base of each transistor and to a bias source, for connecting the base of the transistor to said bias source when the corresponding tone is played;

two switch means, one connected between each end of said set of resistors and the corresponding end resistor;

means connected to said switch means for alternately opening and closing said switch means in synchronism; and shaping and amplifying means coupled to said switch means for alternately receiving signals from opposite ends of said set of resistors through said switch means and for producing an output of uniform amplitude.

2. A circuit as claimed in claim 1 in which the reference voltage level to which said end resistors are connected is ground.

3. A circuit as claimed in claim 1 further comprising:

a gate circuit coupled to the output of said shaping and amplifying means and coupled to said means for alternately opening and closing said switch means for placing a predetermined envelope on the output of said shaping and amplifying means in synchronization with said means for alternately opening and closing said switch means.

4. A circuit as claimed in claim 1 further comprising:

a frequency divider connected to the output of said shaping and amplifying means for producing a signal the frequency of which is a quotient of the frequency of the output of said shaping and amplifying means; and a base switch connected to the output of said shaping and amplifying means in parallel with said frequency divider for controlling the effective operation of said frequency divider.

* * * * *